US010045669B2

(12) United States Patent
Morand

(10) Patent No.: US 10,045,669 B2
(45) Date of Patent: Aug. 14, 2018

(54) ROLLED PRODUCT DISPENSER

(71) Applicant: CASCADES CANADA ULC, Montreal (CA)

(72) Inventor: Michel Morand, Verdun (CA)

(73) Assignee: CASCADES CANAGA ULC, Montreal (CA)

( * ) Notice: Subject to any disclaimer, the term of this patent is extended or adjusted under 35 U.S.C. 154(b) by 602 days.

(21) Appl. No.: 14/752,428

(22) Filed: Jun. 26, 2015

(65) Prior Publication Data

US 2015/0374181 A1 Dec. 31, 2015

Related U.S. Application Data

(60) Provisional application No. 62/018,172, filed on Jun. 27, 2014.

(51) Int. Cl.
*A47K 10/38* (2006.01)
*A47K 10/36* (2006.01)

(52) U.S. Cl.
CPC ..... *A47K 10/38* (2013.01); *A47K 10/3643* (2013.01); *A47K 2010/3863* (2013.01)

(58) Field of Classification Search
CPC ..... A47K 10/38; A47K 10/3643; A47K 2010/3863
See application file for complete search history.

(56) References Cited

U.S. PATENT DOCUMENTS 1,391,326 A * 9/1921 Killian ..... A47K 10/38 242/422.5
2,322,531 A 6/1943 Maltby et al.
2,410,328 A * 10/1946 Agamaite, Jr. ..... A47K 10/22 242/422.4
3,127,121 A * 3/1964 Babin ..... A47K 10/36 226/121
4,222,532 A * 9/1980 DeLuca ..... A47K 10/40 242/423
4,307,638 A 12/1981 DeLuca et al.
(Continued)

FOREIGN PATENT DOCUMENTS

CA 2666201 A1 5/2008
JP H11246093 A 9/1999
JP 2002274719 A 9/2002

*Primary Examiner* — Michael E Gallion
(74) *Attorney, Agent, or Firm* — Marshall, Gerstein & Borun LLP

(57) ABSTRACT

A rolled product dispenser for dispensing a rolled product from a roll is provided. The rolled product dispenser includes a roll engagement member for supporting the roll and allowing the roll to rotate around an axis of rotation, and a roll braking assembly operatively connected to the frame for reducing over-rotation of the roll around the axis of rotation. The roll braking assembly includes at least one roll abutment member configured to abut against an outward-facing surface of the roll and create friction therewith, and a biasing member biasing the at least one roll abutment member towards the outward-facing surface of the roll. The roll braking assembly is configured such that friction between the roll abutment member and the outward-facing surface of the roll reduces as the rolled product is depleted from the roll. In an embodiment, the rolled product dispenser is a paper towel dispenser.

16 Claims, 9 Drawing Sheets

(56) References Cited

U.S. PATENT DOCUMENTS 4,522,346 A * 6/1985 Jespersen ..... A47K 10/40 242/560.3
4,614,312 A * 9/1986 Del Pino ..... A47K 10/40 242/559
4,807,823 A 2/1989 Wyant
4,846,412 A 7/1989 Morand
4,882,568 A * 11/1989 Kyser ..... A47K 10/32 200/61.16
5,009,313 A 4/1991 Morand
5,100,075 A 3/1992 Morand
5,161,723 A 11/1992 Wirtz-Odenthal
5,318,210 A 6/1994 Morand
5,335,811 A 8/1994 Morand
5,833,169 A 11/1998 Morand
5,937,718 A 8/1999 Granger
5,988,561 A * 11/1999 Mele ..... A47K 10/40 242/599.1
6,196,102 B1 3/2001 Granger
6,412,678 B2 7/2002 Gracyalny et al.
6,446,901 B1 9/2002 Haen et al.
6,450,076 B1 9/2002 Granger
6,666,364 B2 * 12/2003 Phelps ..... A47K 10/40 225/106
7,040,566 B1 5/2006 Rodrian et al.
7,530,526 B1 * 5/2009 Powers ..... A47K 10/38 242/422.5
7,537,180 B2 * 5/2009 Morand ..... A47K 10/40 242/596.7
7,984,871 B2 7/2011 Nagata
8,146,471 B2 4/2012 Hansen et al.
8,616,491 B2 * 12/2013 Smith ..... A47K 10/40 242/596.4
9,895,033 B2 * 2/2018 Keily ..... A47K 10/38
2005/0011987 A1 1/2005 Lemaire et al.
2008/0048064 A1 2/2008 Lemaire et al.
2009/0189009 A1 * 7/2009 Rothwell ..... A47K 10/38 242/550
2011/0108598 A1 * 5/2011 Bruner ..... A47K 10/38 225/10
2012/0255413 A1 * 10/2012 Osborne, Jr. ..... A47K 10/3687 83/436.5
2013/0161346 A1 * 6/2013 Wolme ..... A47K 10/38 221/26
2013/0320128 A1 * 12/2013 Cittadino ..... A47K 10/38 242/422.5
2014/0054410 A1 2/2014 Achton
2015/0374181 A1 * 12/2015 Morand ..... A47K 10/38 242/423
2016/0037979 A1 * 2/2016 Mattheeussen ..... A47K 10/38 242/422.1
2016/0135652 A1 * 5/2016 Cittadino ..... A47K 10/38 312/34.8
2016/0242603 A1 * 8/2016 Cvjetkovic ..... A47K 10/38

* cited by examiner

ROLLED PRODUCT DISPENSER

CROSS-REFERENCE TO RELATED APPLICATIONS

This application claims priority under 35 USC § 119(e) of U.S. provisional patent application No. 62/018,172 filed on Jun. 27, 2014, the specification of which is hereby incorporated by reference.

FIELD OF THE INVENTION

The present invention relates to the field of dispensers. More particularly, it relates to a dispenser for rolled products such as rolled paper-based products with an anti-spin assembly interfering with a rotative movement of the roll of rolled product.

BACKGROUND

Several types and models of rolled product dispensers are known in the art for dispensing a length of rolled product to a user. For example and without being limitative, such dispensers are commonly found in public bathrooms for dispensing hand paper towels to users.

In many cases, the length of rolled product is dispensed following a pull of the user on a portion of the web of rolled product dangling at a lower front section of the dispenser, this portion of the web of rolled product being commonly referred to as the "tail". However, it is common for users to pull sharply on the tail of the web of rolled product and consequently cause the roll of rolled product and/or a dispensing roller of the dispenser to overspin, i.e. to continue to rotate after the user has stopped pulling on the tail of the web of rolled product. The overspin of the roll varies in accordance with the weight of the roll, i.e. whether the roll is a new and full roll, a semi-depleted roll, or an almost entirely depleted roll, as heavier rolls tend to overspin more than lighter rolls due to inertia. Overspinning of the roll of rolled product and/or a dispensing roller of the dispenser can lead to an accumulation of rolled product between the roll and the dispensing roller assembly.

In view of the above, there is a need for an improved rolled product dispenser, which by virtue of its design and components, would be able to overcome or at least minimize some of the above-discussed prior art concerns.

SUMMARY

According to an aspect, a paper towel dispenser for dispensing paper towels from a paper towel roll is provided. The paper towel dispenser includes a housing, a roll support provided in the housing for rotatably supporting the paper towel roll, a roll braking assembly provided in the housing for reducing overspinning of the paper towel roll, and a dispensing assembly provided in the housing for dispensing the paper towels from a tail portion of the paper towel roll. The roll braking assembly includes at least one roll abutment member having an abutment surface configured to abut against an outward-facing surface of the paper towel roll and apply thereto a friction force which decreases as the roll is depleted, and a biasing member for biasing the abutment surface of the at least one roll abutment member towards the outward-facing surface of the paper towel roll.

In an embodiment, the roll support includes at least one support arm extending along a side surface of the roll, the at least one support arm having a roll engagement end including a roll engagement member, and wherein the roll braking assembly is mounted to the at least one support arm and the at least one roll engagement member includes a biasing surface opposite the abutment surface with the biasing member extending between the at least one support arm and the biasing surface of the at least one roll abutment member.

In an embodiment, the at least one roll abutment member is positioned such that the abutment surface abuts a side surface of the roll, the abutment surface of the at least one roll abutment member being tapered towards an end of the abutment surface adjacent to the roll engagement member.

In an embodiment, the at least one support arm includes two support arms extending along opposite sides of the roll and the at least one roll abutment member includes two roll abutment members and each one of the two support arms includes a respective one of the roll abutment members.

In an embodiment, the at least one roll abutment member further includes guide walls extending laterally from opposite sides of the abutment surface and the at least one support arm includes slots, the guide walls fitting within corresponding slots to allow a translation of the abutment surface toward and away from the outward-facing surface of the roll.

In an embodiment, the biasing member is a compressive element which exerts an increasing force on the at least one roll abutment member as it is compressed and the at least one roll abutment member is offset from the axis of rotation of the roll.

In an embodiment, the at least one roll abutment member is positioned such that a surface area of the at least one roll abutment member abutting the outward-facing surface of the roll reduces as the roll is depleted and that that a biasing force of the biasing member biasing the abutment surface towards the outward-facing surface of the roll reduces as the roll is depleted.

According to an aspect, a rolled product dispenser for dispensing a rolled product from a roll having an outward-facing surface is provided. The rolled product dispenser includes a frame and a roll braking assembly. The frame includes a roll engagement member for supporting the roll and allowing the roll to rotate around an axis of rotation. The roll braking assembly is operatively connected to the frame for reducing over-rotation of the roll around the axis of rotation, and includes at least one roll abutment member having an abutment surface configured to abut against the outward-facing surface of the roll and create friction therewith, and a biasing member biasing the abutment surface of the at least one roll abutment member towards the outward-facing surface of the roll. The roll braking assembly is configured such that the friction between the abutment surface and the outward-facing surface of the roll reduces as the rolled product is depleted from the roll.

In an embodiment, the at least one roll abutment member is positioned such that the abutment surface abuts a side surface of the roll, the abutment surface being tapered towards an end of the abutment surface adjacent to the roll engagement member.

In an embodiment, the at least one roll abutment member further comprises guide walls extending laterally from opposite sides of the abutment surface and the frame includes slots, the guide walls fitting within corresponding slots in the frame to allow a translation of the abutment surface toward and away from the outward-facing surface of the roll.

In an embodiment, the guide walls include a stop member, the stop member being abuttable with the corresponding slots in the frame to prevent a movement of the abutment surface beyond a predetermined translation limit.

In an embodiment, the at least one roll abutment member includes a biasing surface opposite the abutment surface, the biasing member extending between the frame and the biasing surface.

In an embodiment, the frame includes at least one support arm extending along the side surface of the roll, the at least one support arm having a roll engagement end including the at least one roll engagement member, and the roll braking assembly is mounted to the at least one support arm and the at least one roll abutment member includes a biasing surface opposite the abutment surface with the biasing member extending between the at least one support arm and the biasing surface of the at least one roll abutment member.

In an embodiment, the at least one support arm includes two support arms extending along opposite sides of the roll and the at least one roll abutment member includes two roll abutment members, each one of the two support arms including a respective one of the roll abutment members.

In an embodiment, the at least one roll abutment member further includes guide walls extending laterally from opposite sides of the abutment surface and the at least one support arm includes slots, the guide walls fitting within corresponding slots to allow a translation of the abutment surface toward and away from the outward-facing surface of the roll.

In an embodiment, the at least one roll abutment member is positioned such that the abutment surface abuts a peripheral surface of the roll, and the biasing member is a compressive element which exerts an increasing force on the at least one roll abutment member as it is compressed.

In an embodiment, the compressive element is a compression spring.

In an embodiment, the abutment surface of the at least one roll abutment member includes a profile complementary to a curved contour of the peripheral surface of the roll.

In an embodiment, the abutment surface of the at least one roll abutment member includes a profile complementary to a curved contour of the peripheral surface of a full roll of rolled product.

In an embodiment, the at least one roll abutment member is offset from the axis of rotation of the roll.

In an embodiment, the housing includes a front section and a rear section, and the roll braking assembly is mounted to at least one of the front section and the rear section.

In an embodiment, the front section of the housing includes a removable cover, the roll breaking assembly being mounted to the removable cover.

In an embodiment, the at least one roll abutment member includes two roll abutment members provided on opposite outward-facing surfaces of the roll, when the roll is engaged with the roll engagement member.

In an embodiment, the at least one roll abutment member is positioned such that substantially an entire surface area of the abutment surface is in contact with the outward-facing surface of the roll when the roll is substantially non-depleted.

In an embodiment, the at least one roll abutment member is positioned such that a surface area of the at least one roll abutment member abutting the outward-facing surface of the roll reduces as the roll is depleted.

In an embodiment, the at least one roll abutment member is positioned such that a biasing force of the biasing member biasing the abutment surface towards the outward-facing surface of the roll reduces as the roll is depleted.

In an embodiment, the abutment surface of the at least one roll abutment member is textured.

In an embodiment, the abutment surface of the at least one roll abutment member has a triangular rib texture.

In an embodiment, the rolled product dispenser includes a dispensing assembly for dispensing the rolled product from the roll.

According to an aspect, there is provided a rolled product dispenser for dispensing a rolled product from a roll having a side surface. The rolled product dispenser comprises a roll support configured to support the roll, with an anti-spin assembly mounted thereto. The anti-spin assembly comprises at least one roll abutment member and a biasing member operatively connected to the at least one roll abutment member and biasing the at least one roll abutment member towards the side surface of the roll engaged with the roll support to apply a force thereon and interfere with a rotative movement of the roll.

In an embodiment, the roll support comprises support arms extending on opposed sides of the roll and the at least one roll abutment member is operatively connected to a corresponding one of the support arms and biased away therefrom In an embodiment, the anti-spin assembly is configured to decrease the force applied on the side surface of the roll as a diameter of the roll decreases.

In an embodiment, the at least one roll abutment member comprises an abutment surface having a surface area abuttable with the side surface of the roll and the surface area of the abutment surface abutting with the side surface of the roll decreases as the diameter of the roll decreases.

In an embodiment, the roll support comprises a distal end section with a roll engagement member engageable in a bore of the roll and the abutment surface is tapered towards the distal end section.

In an embodiment, the rolled product dispenser further comprises a dispensing assembly including a rotating drum having a peripheral wall configured to be contoured at least partially by a web of the rolled product.

According to another general aspect, there is also provided a rolled product dispenser for dispensing a rolled product from a roll having a side surface, the rolled product dispenser comprises a housing and a roll support having support arms connected to the housing and extending on opposed sides of the roll. Each one of the support arms has a distal end section with a roll engagement member. The rolled product dispenser also comprises an anti-spin assembly having at least one roll abutment member operatively connected to a corresponding one of the support arms and having an abutment surface. The anti-spin assembly is configured to apply a force on the side surface of the roll by pressing the abutment surface of the roll abutment member against the side surface of the roll.

In an embodiment, the anti-spin assembly is configured to decrease the force applied on the side surface of the roll as a diameter of the roll decreases.

In an embodiment, the anti-spin assembly comprises a biasing member operatively connected to the at least one roll abutment member and biasing the at least one roll abutment member towards the side surface of the roll engaged with the roll support to interfere with a rotative movement of the roll In an embodiment, the abutment surface has a surface area abuttable with the side surface of the roll and the surface area of the abutment surface abutting with the side surface of the roll decreases as the diameter of the roll decreases.

In an embodiment, the abutment surface is tapered towards the distal end section of the corresponding one of the support arms.

In an embodiment, the rolled product dispenser further comprises a dispensing assembly including a rotating drum having a peripheral wall configured to be contoured at least partially by a web of the rolled product.

According to still another general aspect, there is also provided a paper towel dispenser for dispensing paper towels from a paper towel roll. The paper towel dispenser comprises: a housing; a roll support provided in the housing for rotatably supporting the paper towel roll around an axis of rotation; a roll braking assembly provided in the housing for reducing overspinning of the paper towel roll, and a dispensing assembly provided in the housing for dispensing the paper towels from a tail portion of the paper towel roll. The roll braking assembly comprises: at least one roll abutment member having an abutment surface configured to bias and abut against an outward-facing side surface of the paper towel roll and configured to apply thereto a friction force thereon which decreases as the roll is depleted.

In an embodiment, the roll braking assembly comprises a biasing member for biasing the abutment surface of the at least one roll abutment member towards the outward-facing side surface of the paper towel roll.

In an embodiment, the roll support comprises at least one support arm extending along one of the side surfaces of the roll, the at least one support arm having a roll engagement end comprising a roll engagement member, and wherein the roll braking assembly is mounted to the at least one support arm. The roll braking assembly can comprise a biasing member for biasing the abutment surface of the at least one roll abutment member towards the outward-facing side surface of the paper towel roll and the at least one roll engagement member can comprise a biasing surface opposite the abutment surface with the biasing member extending between the at least one support arm and the biasing surface of the at least one roll abutment member.

According to a further general aspect, there is also provided a rolled product dispenser for dispensing a rolled product from a roll having an outward-facing side surface. The rolled product dispenser comprises: a frame comprising a roll engagement member for supporting the roll and allowing the roll to rotate around an axis of rotation; and a roll braking assembly operatively connected to the frame for reducing over-rotation of the roll around the axis of rotation, the roll braking assembly comprising: at least one roll abutment member having an abutment surface configured to bias and abut against the outward-facing side surface of the roll and create friction therewith. The roll braking assembly is configured such that the friction between the abutment surface and the outward-facing side surface of the roll reduces as the rolled product is depleted from the roll.

In an embodiment, the roll braking assembly comprises a biasing member biasing the abutment surface of the at least one roll abutment member towards the outward-facing side surface of the roll.

According to another general aspect, there is also provided a rolled product dispenser for dispensing a rolled product from a roll having an outward-facing surface. The rolled product dispenser comprises a roll support configured to support the roll, with an anti-spin assembly mounted thereto. The anti-spin assembly comprises at least one roll abutment member and a biasing member operatively connected to the at least one roll abutment member and biasing the at least one roll abutment member towards the outward-facing surface of the roll engaged with the roll support to apply a force thereon and interfere with a rotative movement of the roll.

BRIEF DESCRIPTION OF THE DRAWINGS

Other objects, advantages and features will become more apparent upon reading the following non-restrictive description of embodiments thereof, given for the purpose of exemplification only, with reference to the accompanying drawings in which:

FIG. 2*a* shows the support arm of the roll support without a roll of rolled product mounted thereto, FIG. 2*b* shows the support arm of the roll support with a full roll of rolled product mounted thereto, FIG. 2*c* shows the support arm of the roll support with a semi-depleted roll of rolled product mounted thereto, and FIG. 2*d* shows the support arm of the roll support with an almost depleted roll of rolled product mounted thereto.

DETAILED DESCRIPTION

In the following description, the same numerical references refer to similar elements. The embodiments, geometrical configurations, materials mentioned and/or dimensions shown in the figures or described in the present description are embodiments only, given solely for exemplification purposes.

Moreover, although the embodiments of the rolled product dispenser and corresponding parts thereof consist of certain geometrical configurations as explained and illustrated herein, not all of these components and geometries are essential and thus should not be taken in their restrictive sense. It is to be understood, as also apparent to a person skilled in the art, that other suitable components and cooperation thereinbetween, as well as other suitable geometrical configurations, may be used for the rolled product dispenser, as will be briefly explained herein and as can be easily inferred herefrom by a person skilled in the art. Moreover, it will be appreciated that positional descriptions such as "above", "below", "left", "right" and the like should, unless otherwise indicated, be taken in the context of the figures and should not be considered limiting.

Figure 1:
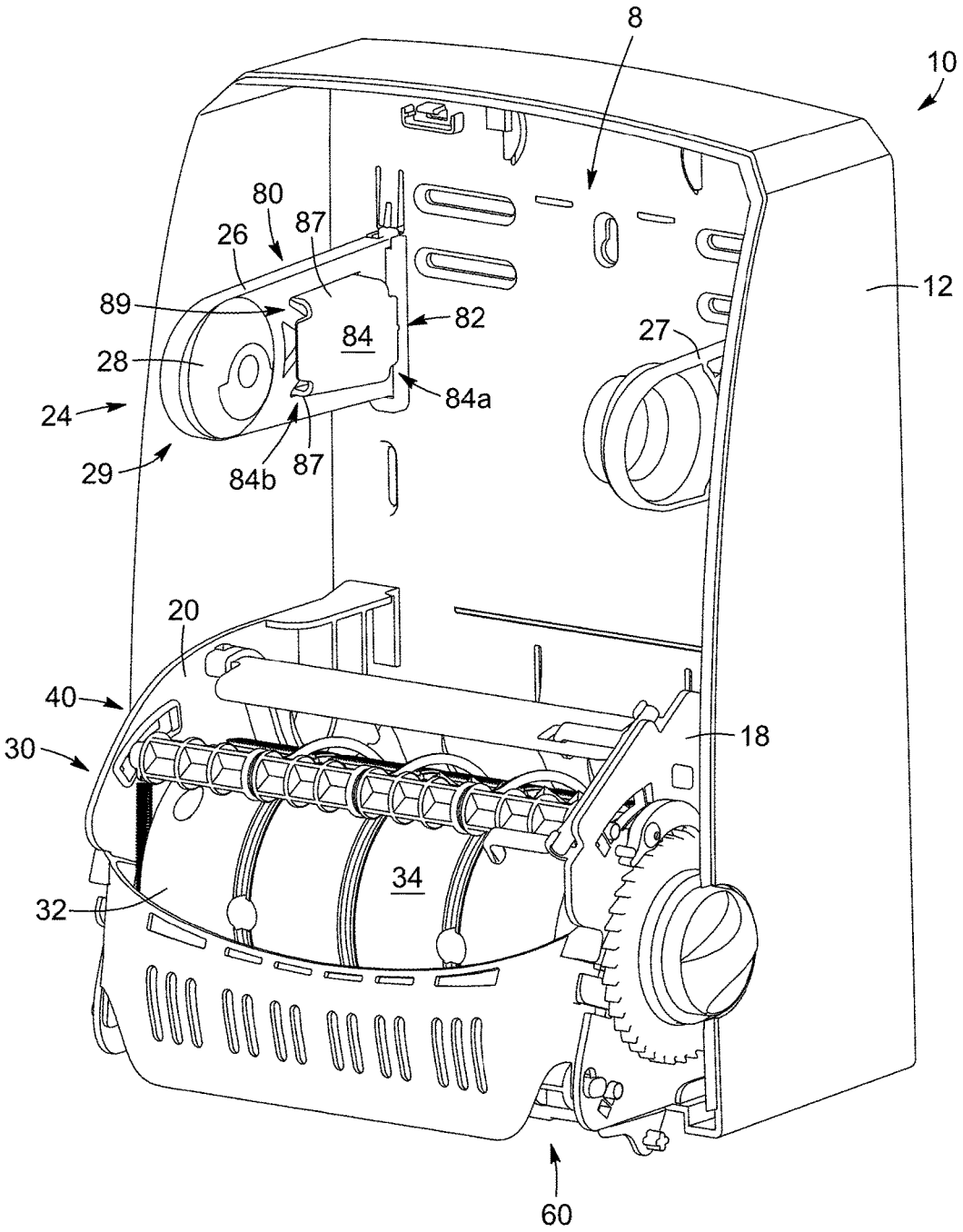
FIG. 1 is a perspective view of a rolled product dispenser, according to an embodiment, with no roll of rolled product mounted thereto.
Figure 2A:
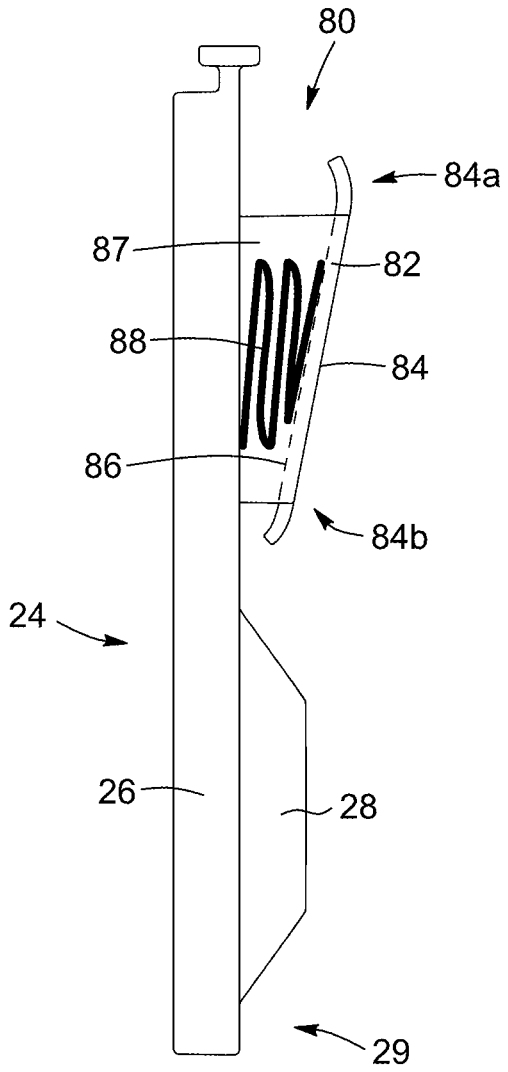
FIGS. 2*a* to 2*d* are cross-sectional plan views of a support arm of a roll support of the rolled product dispenser of FIG. 1, wherein the support arm includes a roll braking assembly, where
Figure 2B:
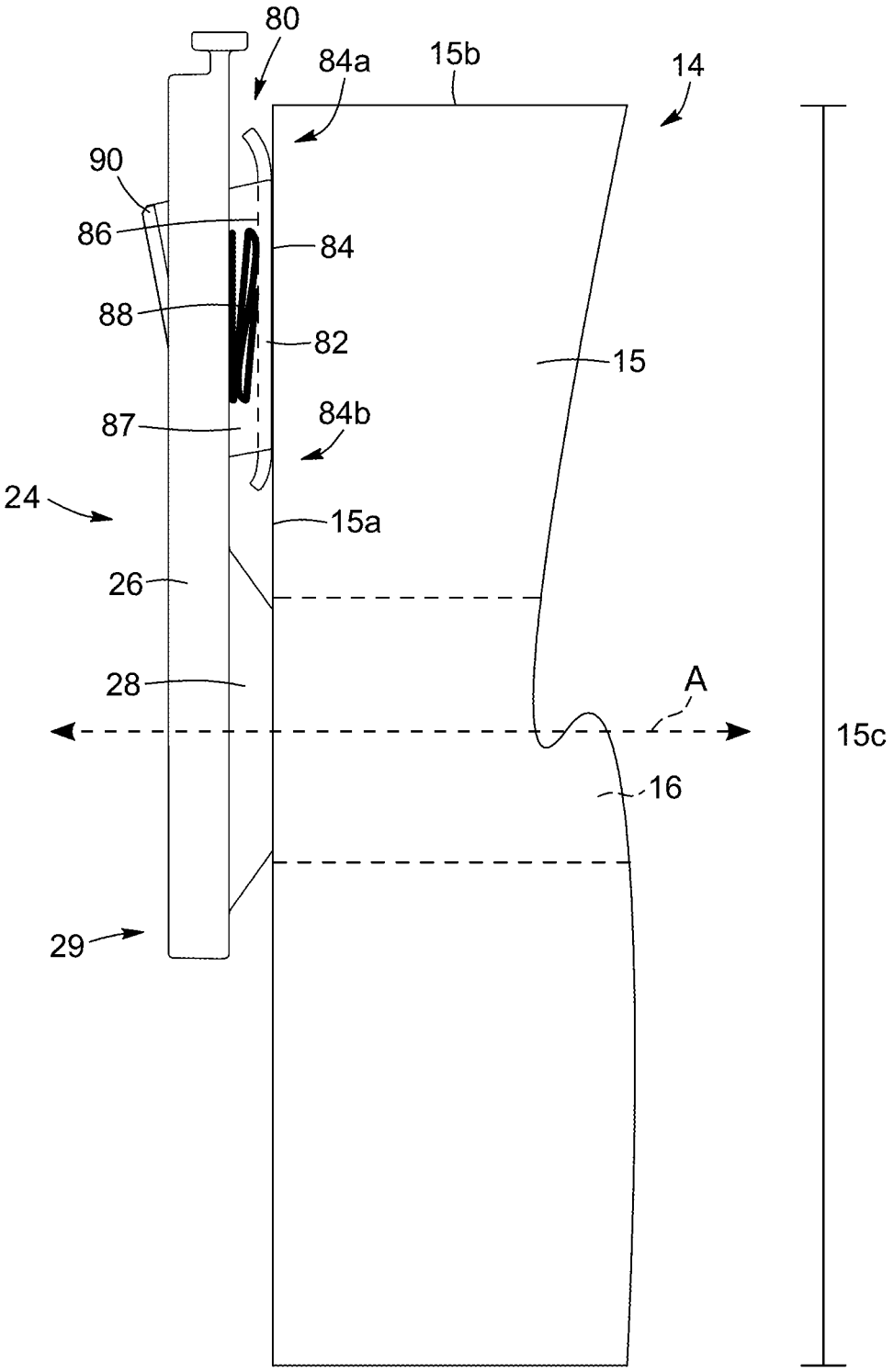
Figure 2C:
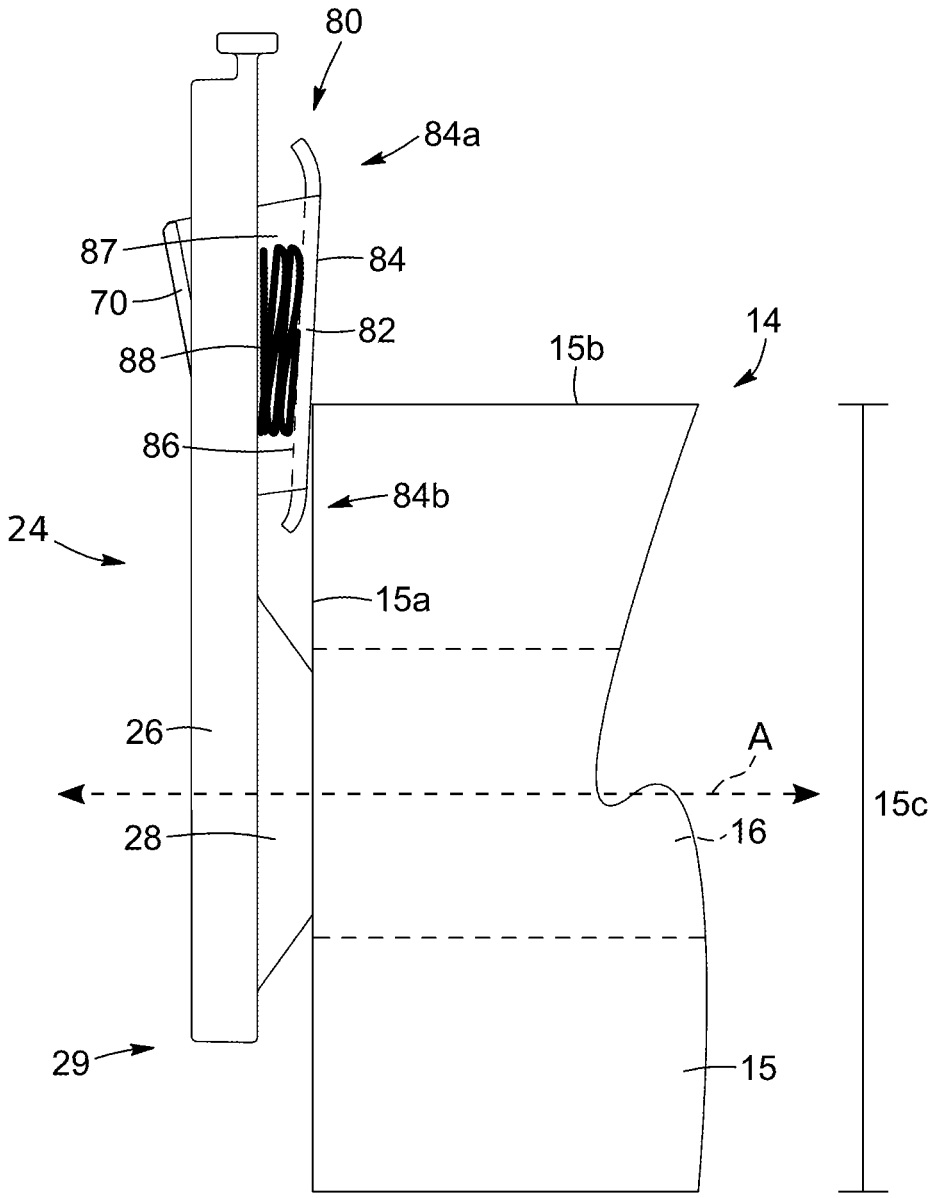
Figure 2D:
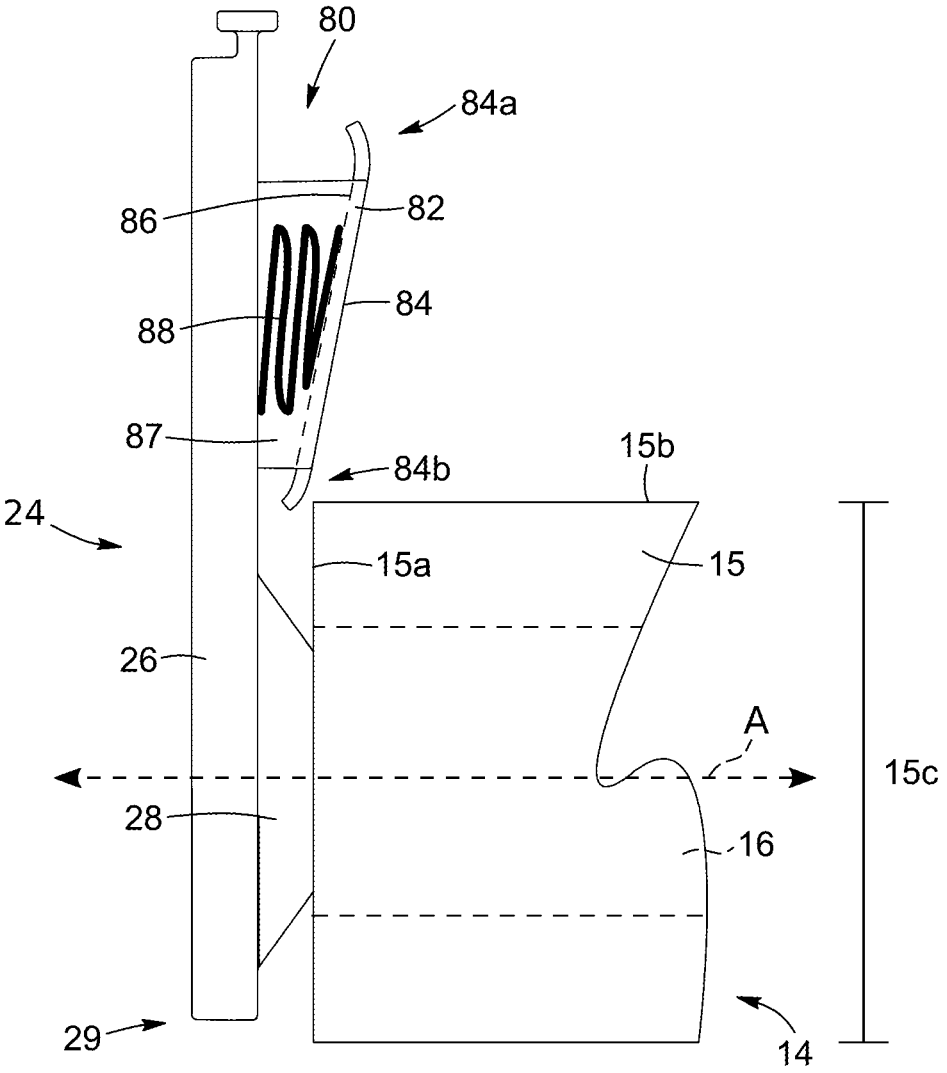

Referring to FIGS. 1 to 2*d*, there is shown an embodiment of a rolled product dispenser 10. The rolled product dispenser 10 includes a frame 8 which serves as a support for the various components in the system. In the illustrated embodiment, the frame 8 includes a housing 12. The housing 12 is made of moulded plastic such as acrylonitrile butadiene styrene (ABS). However, one skilled in the art will understand that other materials offering similar characteristics could be used in the manufacture of the housing 12.

Figure 4:
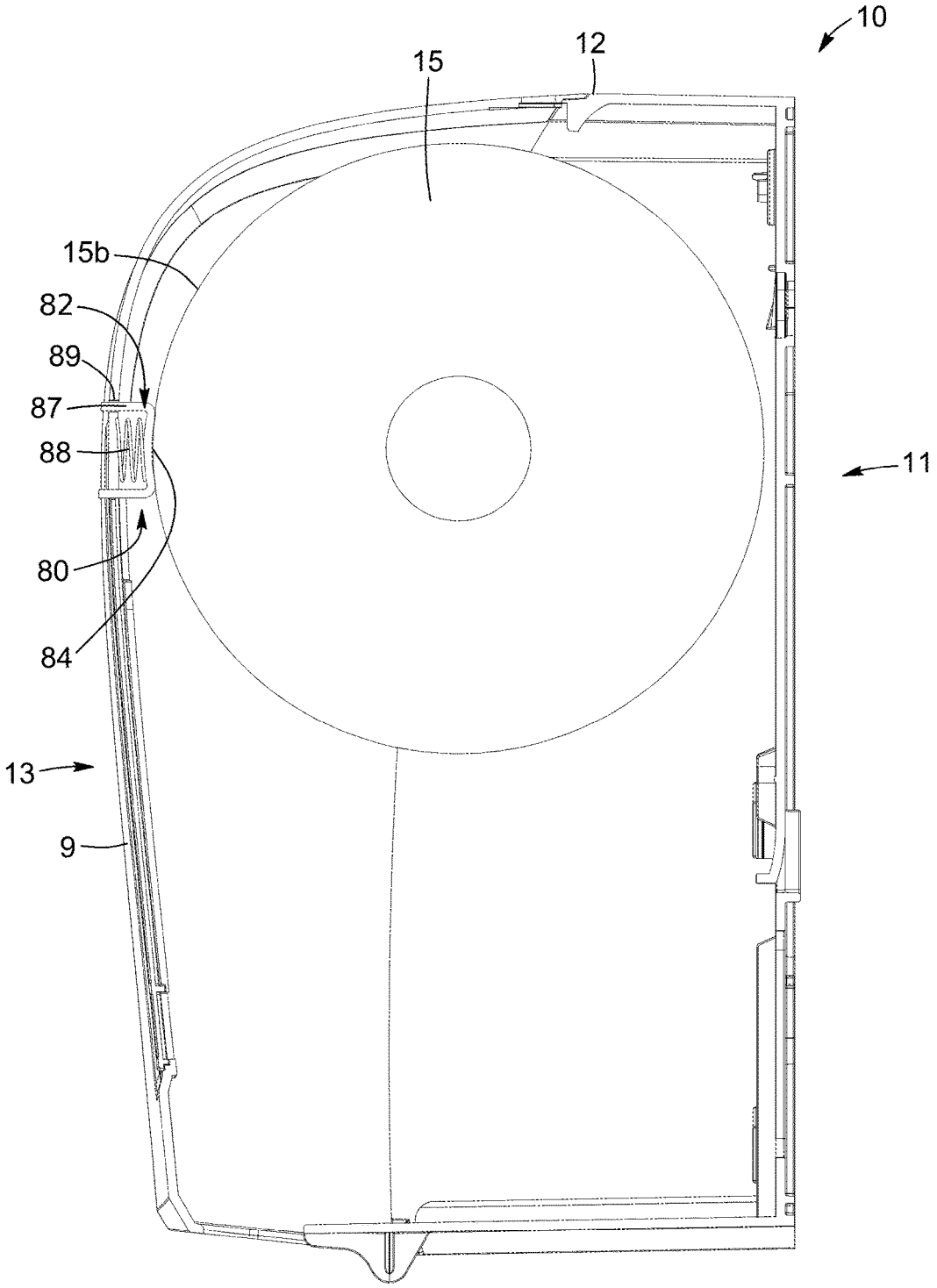
FIG. 4 is a cross-sectional side view of a rolled product dispenser, according to another embodiment including a roll braking assembly mounted to a front section of a housing of the rolled product dispenser.
Figure 5A:
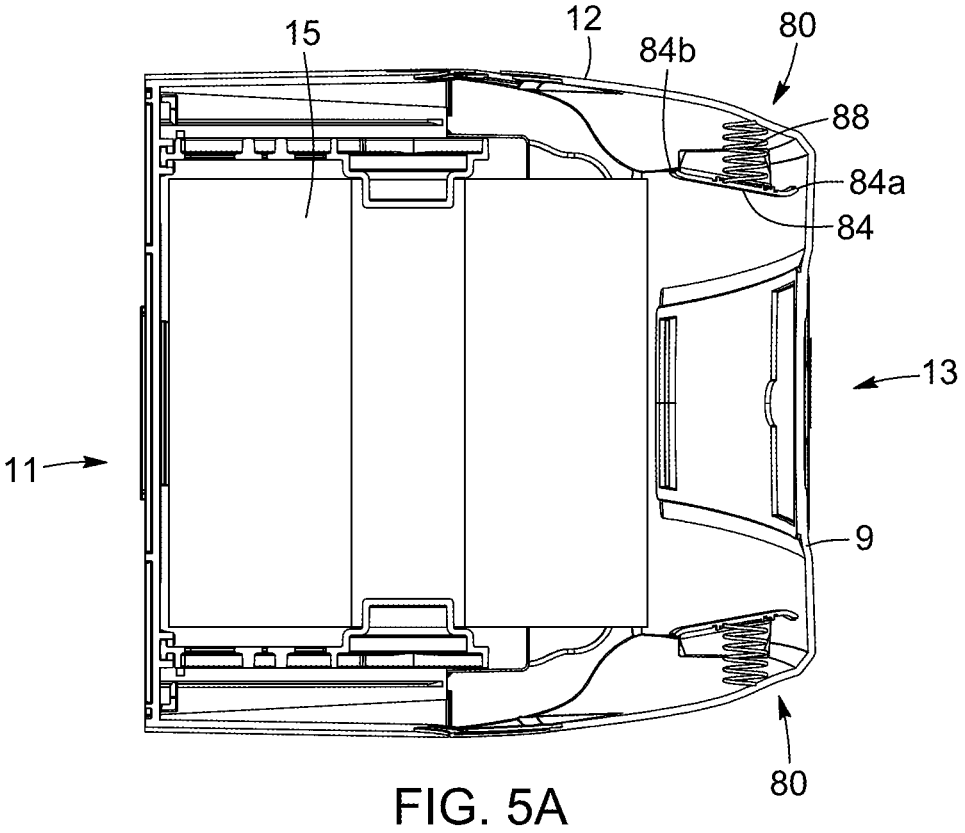
FIGS. 5*a* and 5*b* are cross-sectional plan views of a rolled product dispenser, according to another embodiment including a roll braking assembly mounted to side walls of a housing of the rolled product dispenser, FIG. 5*a* showing a front cover of the rolled product dispenser in an open position, and 5*b* showing the front cover of the rolled product in a closed position.
Figure 5B:
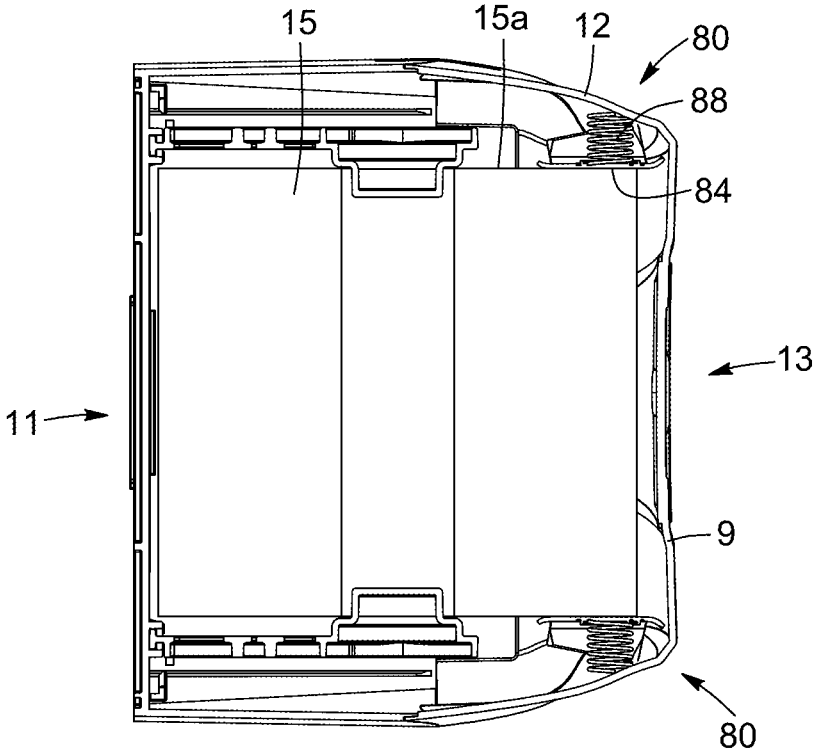

In an embodiment, for example as shown in the embodiments of FIGS. 4, 5*a* and 5*b*, the housing 12 includes a protective front cover 9 at a front section 13 of the housing 12, in order to cover the internal components of the dispenser 10. The cover 9 can be removably mounted to a rear section 11 of the housing 12 using known mounting techniques such as, without being limitative, hinges or the like.

Referring back to FIGS. 1 to 2*d*, the rolled product dispenser 10 includes a roll support 24 connected to the housing 12 and configured to support a roll 15 of rolled product 14. As will be easily understood by one skilled in the art, the rolled product 14 can be a web of absorbent sheet product provided in a rolled configuration, such as, without being limitative, hand paper towel. However, the rolled product 14 could be any type of paper provided in a roll, such as, without being limitative, toilet paper, or other types of rolled product, such as cling film, foil or the like.

The rolled product dispenser 10 further includes a dispensing assembly 30 mounted below the roll support 24 and configured to dispense lengths of a web of the rolled product 14 to a user. The housing 12 comprises a dispensing opening through which a tail (not shown) of the web of rolled product 14 may extend and on which the user can pull to dispense a length of rolled product 14.

In the embodiment shown, the dispensing assembly 30 includes a rotating drum 32 (or dispensing roller), rotatably mounted between supporting members 18 and 20. The rotating drum 32 has a peripheral wall 34 engaging the web of rolled product 14. When a user pulls on a tail of the web of rolled product 14, extending outwardly of the housing 12 through the dispensing opening, the rotating drum 32 rotates in a dispensing rotation direction and a length of the web of rolled paper product 14 is dispensed to the user.

In an embodiment, the rotating drum 32 also includes a cutting assembly (not shown) housed in the rotating drum 32 and configured to cut the web of rolled product 14 after a predetermined length has been dispensed. One skilled in the art would however understand that, in alternative embodiments, other mechanisms or assemblies for automatically or manually cutting the web of rolled product 14 could be provided.

In the embodiment shown, the dispensing assembly 30 further includes an upper tensioning mechanism 40 and a lower tensioning mechanism 60 configured to guide the web of rolled product 14 such that it contours the rotating drum 32, along a greater section thereof, and a return mechanism (not shown) configured to cause the rotating drum 32 to rotate back to its original angular position (neutral position) within the dispenser 10, following a rotation of the rotating drum 32 in the dispensing rotation direction caused by a pull on the web of rolled product 14 by a user.

One skilled in the art will however understand that, in an alternative embodiment, the dispensing assembly 30 could be different than the dispensing assembly 30 of the embodiment shown. Moreover, the dispensing assembly 30 could be free of the upper tensioning mechanism 40, lower tensioning mechanism 60 and return mechanism (not shown), or be provided with only one or two of these components.

Referring to FIGS. 1 to 2*d*, as mentioned above, the dispenser 10 includes the roll support 24, mounted above the dispensing assembly 30, to support a roll 15 of the rolled product 14 while allowing the roll 15 to spin around an axis of rotation A. In the embodiment shown, the roll support 24 comprises a structure presenting a left arm 26 and a right arm 27 mounted to the housing 12 and extending respectively on the left side and the right side of the roll 15 of rolled product 14, when a roll 15 is mounted thereto. A roll engagement member 28 is provided to each one of the arms 26, 27, in a distal end section 29 (or roll engagement end) thereof, and is engageable with the roll 15 of rolled product 14 by projecting into a central bore 16 thereof. In an embodiment, the flexibility of the arms 26, 27 allows the roll support 24 to be easily spread open in order to remove a depleted roll and refill the dispenser 10 with a new roll 15 of rolled product 14, when necessary.

As will be easily understood by one skilled in the art, in alternative embodiments, other types of roll supports, providing adequate support to the roll 15 of rolled product 14 and easy refill of the dispenser 10 could be used in connection with the present dispenser 10. For example and without being limitative, the roll engagement members 28 could be mounted directly on the housing 12, without the use of the above described arms 26, 27. In such an embodiment, the roll supports 24 comprise at least a portion of the housing 12, such as the lateral walls, with the roll engagement member 28 mounted thereto. In another embodiment (not shown), the roll support can extend from the dispensing assembly.

In an embodiment (not shown), at least one of the engagement members 28 of the roll support 24 includes a head being part of an engagement system such as the one described in Canadian Patent No. 2,545,130 and incorporated herein by reference. The engagement system also comprises a bushing inserted in the central bore 16 of the roll 15 and engageable to the head. The engagement system thus comprises the head and the complementary bushing, engageable with one another to mount the roll 15 to the engagement member 28.

In order to reduce overspinning of the roll 15 around its axis of rotation A, for example following a sharp pull of a user on the tail of the web of rolled product 14 extending outside of the housing 12, an anti-spin or roll braking assembly 80 is operatively connected to the frame 8. In the embodiments of FIGS. 1 to 2*d*, the roll braking assembly 80 is provided in the housing 12. The roll braking assembly 80 is configured to interfere with the rotative movement of the roll 15 around its axis of rotation in such a way that the interference reduces as the roll 15 is depleted. In the presently illustrated embodiment, the roll braking assembly 80 is mounted to the roll support 24 and offset from the axis of rotation A of the roll 15. The roll braking assembly 80 can be configured to abut with an outward-facing surface 15*a*, 15*b* of the roll 15 and create friction therewith. The roll braking assembly 80 can be configured such that the friction reduces as the roll is depleted. In the illustrated embodiment, the roll braking assembly 80 abuts with a side surface 15*a* of the roll 15. The roll braking assembly 80 is provided on the left support arm 26 of the roll support 24. However, one skilled in the art will understand that, in an alternative embodiment, the roll braking assembly 80 could be provided on the right support arm 27 or on each one of the left support arm 26 and the right support arm 27.

It should be understood that the roll braking assembly 80 can be mounted directly on the housing 12 of the dispenser 10. With reference to FIGS. 5*a* and 5*b*, in an embodiment, the front section 13 of the housing 12 comprises the removable cover 9 which is shown in an open position in FIG. 5*a* and a closed position in FIG. 5*b*. The roll braking assembly 80 is mounted on opposite sides of the cover 9 and positioned so that when the cover 9 is closed, the roll braking assembly 80 abuts with the side surfaces 15*a* of the roll 15.

In the above described embodiment (not shown) where at least one of the engagement members 28 of the roll support 24 includes a head being part of an engagement system, the roll braking assembly 80 can be provided on the corresponding one of the support arms 26, 27 where the engagement member 28 of the roll support 24 includes the head. Once again, the roll braking assembly 80 can be mounted directly on the housing 12 of the dispenser 10, on the same side as the engagement member 28 of the roll support 24 which includes the head, so that the roll braking assembly 80 abuts the side surface 15*a* of the roll 15.

Referring back to FIGS. 1 to 2*d*, in an embodiment, the roll braking assembly 80 includes a roll abutment member 82 having an external abutment surface 84 and an internal biasing surface 86. In other words, the abutment surface 84 and the biasing surface 86 are opposite one another. The roll braking assembly 80 also includes a biasing member 88 configured to bias the roll abutment member 82 away from the corresponding support arm 26 and inwardly towards the side surface 15*a* of the roll 15 of rolled product 14 to press the abutment surface 84 of the roll abutment member 82 against the side surface 15*a* of the roll 15. The biasing member 88 is positioned between the corresponding support arm 26 and the biasing surface 86 of the roll abutment member 82, so as to apply a pressure on the biasing surface 86 of the roll abutment member 82 and perform the above-described bias of the roll abutment member 82 away from the corresponding support arm 26. In the embodiment shown, the biasing member 88 is a compression spring, but one skilled in the art will understand that, in alternative embodiments, the biasing member 88 could be another component with resilient properties. One skilled in the art will understand that, in alternate embodiments, the biasing member 88 can be provided elsewhere, so long as it biases the abutment member 82 towards an outward-facing surface 15*a*, 15*b* of the roll 15. For example, in an embodiment where the roll braking assembly 80 is mounted directly to the frame 8, the biasing member 88 can be positioned between the frame 8 and the biasing surface 86 of the roll abutment member 82 as shown in FIGS. 3 to 5B.

In an alternative embodiment (not shown), the roll braking assembly can include a roll abutment member which is biased towards the roll 15 of rolled product 14. For instance, the roll abutment member can be made of a material having biasing properties when compressed, such as and without being limitative spring steel. For instance, the roll abutment member can be substantially V-shaped. When inserting a non-depleted (or substantially full) roll, the V-shaped roll abutment member is compressed and applies a friction force against the side surface 15*a* of the roll 15. As lengths of the rolled product 14 are dispensed to users, a diameter 15*c* of the roll 15 decreases, and the V-shaped roll abutment member returns to its uncompressed state. Simultaneously, the force applied on the side surface 15*a* of the roll 15 by the roll abutment member, which interferes with the rotative movement of the roll 15, decreases as the diameter 15*c* of the roll 15 decreases.

In an embodiment, the roll abutment member 82 also includes connecting walls or guide walls 87 extending laterally from the abutment surface 84, towards the corresponding support arm 26. A section of each one of the guide walls 87 is slidable in a slot 89 defined in the corresponding support arm 26, such as to allow a translation of the abutment surface 84 of the roll abutment member 82 towards and away from the corresponding support arm 26. In an embodiment, a stop member 90 is provided at an end of each one of the guide walls 87. The stop members 90 are abuttable with the corresponding support arm 26, for example along the slot 89, to prevent movement of the roll abutment member 82 away from the corresponding support arm 26, beyond a predetermined translation limit, thereby maintaining each one of the guide walls 87 engaged in the corresponding slot 89 to maintain the engagement between the roll abutment member 82 and the corresponding support arm 26. It should be understood that, in alternate embodiments, the slots can be provided elsewhere. For example, in an embodiment where the roll braking assembly 80 is mounted directly to the frame 8, the slots 89 can be defined directly in the frame 8.

As previously mentioned, one skilled in the art will understand that overspinning of the roll 15 of rolled product 14 will vary depending on the size of roll 15. Indeed, a bigger roll (for example a full roll), which is heavier and has a greater inertia, will tend to overspin more than a smaller roll (for example a semi-depleted roll), which is lighter and has a smaller inertia. Therefore, the force applied against the side wall 15*a* of the roll 15, i.e. the frictional force, required to reduce such overspin will be greater for non-depleted rolls than for, for example semi-depleted rolls.

In order to address this issue, referring to FIGS. 2*b* to 2*d*, in an embodiment the roll abutment member 82 is positioned such that substantially an entire surface area of the abutment surface 84 abuts with the side surface 15*a* of the roll 15, when the roll is in a substantially non-depleted (or substantially full) state, i.e. the roll 15 is a new roll or a substantially small amount of rolled product 14 has been removed from the roll 15 and dispensed to users (as shown in FIG. 2*b*). As lengths of the rolled product 14 are dispensed to users, a diameter 15*c* of the roll 15 decreases, i.e. the roll 15 becomes in a semi-depleted state (as shown in FIG. 2*c*), and the surface area of the abutment surface 84 abutting with the side surface 15*a* of the roll 15 decreases proportionally. In other words, a portion of the surface area of the abutment surface 84 becomes outside of a peripheral wall 15*b* of the roll 15 and therefore does not abut with the side surface 15*a* of the roll 15 anymore. Consequently, it will be understood that the force applied on the side surface 15*a* of the roll 15 by the roll abutment member 82, which interferes with the rotative movement of the roll 15, accordingly decreases as the diameter 15*c* of the roll 15 decreases.

When a substantial portion of the of rolled product 14 has been dispensed to users (and consequently removed from the roll 15) such that the roll 15 has reached an almost completely depleted state, the size and weight of the roll 15 is such that the roll 15 has a small inertia and does not tend to overspin. Therefore, with reference to FIG. 2*d*, in the embodiment shown, the roll abutment member 82 is positioned such that none of the surface area of the abutment surface 84 abuts with the side surface 15*a* of the roll 15 in an almost completely depleted state and the roll braking assembly 80 therefore does not interfere with the rotative movement of the roll 15 when such a state is reached.

In an embodiment, the roll abutment member 82 is further configured such that the abutment surface 84 is inclined relative to the corresponding support arm 26 when no roll 15 is mounted thereto (as shown in FIG. 2*a*). As can be seen, the abutment surface 84 is tapered towards an end of the abutment surface 84 proximate or adjacent to the roll engagement member 28, such that the abutment surface 84 extends further away from the corresponding arm 26 at an end 84*a* away from the roll engagement member 28, than at the end 84*b* proximate to the roll engagement member 28. In other words the abutment surface 84 is tapered towards the distal end section 29 of the arm 26 end closer to the roll engagement member 28. Tapering of the abutment surface 84 results in a greater force (or pressure) being exerted by the roll abutment member 82 on the side surface 15*a* of the roll 15 towards the peripheral wall 15*b* than towards the central bore 16 of the roll 15. Such tapering therefore also helps in decreasing the force applied on the side surface 15*a* of the roll 15 by the roll abutment member 82, as the diameter of the roll 15 decreases.

In other possible configurations, the roll abutment member 82 can be configured such that the abutment surface 84 abuts with an outer peripheral wall 15*b* of the roll 15. In an embodiment, and with reference to FIG. 3, the roll braking assembly 80 is mounted to the rear section 11 of the housing 12. The abutment surface 84 is biased away from the rear section 11 by the biasing member 88. The guide walls 87 extending from the abutment surface 84 fit within corresponding slots 89 in the housing 12. In this configuration, the abutment surface 84 is biased towards the outer peripheral wall 15*b* of the roll 15 when the roll 15 is mounted to the roll support 24.

In the presently illustrated embodiment, the biasing member 88 is a compression spring. As can be appreciated, the friction between the abutment surface 84 and the roll 15 will vary according to the diameter 15*c* of the roll 15. When the roll 15 is full, the outer peripheral wall 15*b* will abut heavily against the abutment surface 84, causing the roll abutment member 82 to displace towards the rear of the housing 11, and therefore cause the spring 88 to compress significantly. The spring 88 opposes the compression with a force which causes a friction between the abutment surface 84 and the roll 15. This force increases the further the spring 88 is compressed. As the roll 15 is depleted, the abutment member 82 is displaced less, and the spring 88 is subject to less compression. The force is thus reduced as the roll 15 is depleted, thus causing less friction between the abutment surface 84 and the roll 15.

Figure 3:
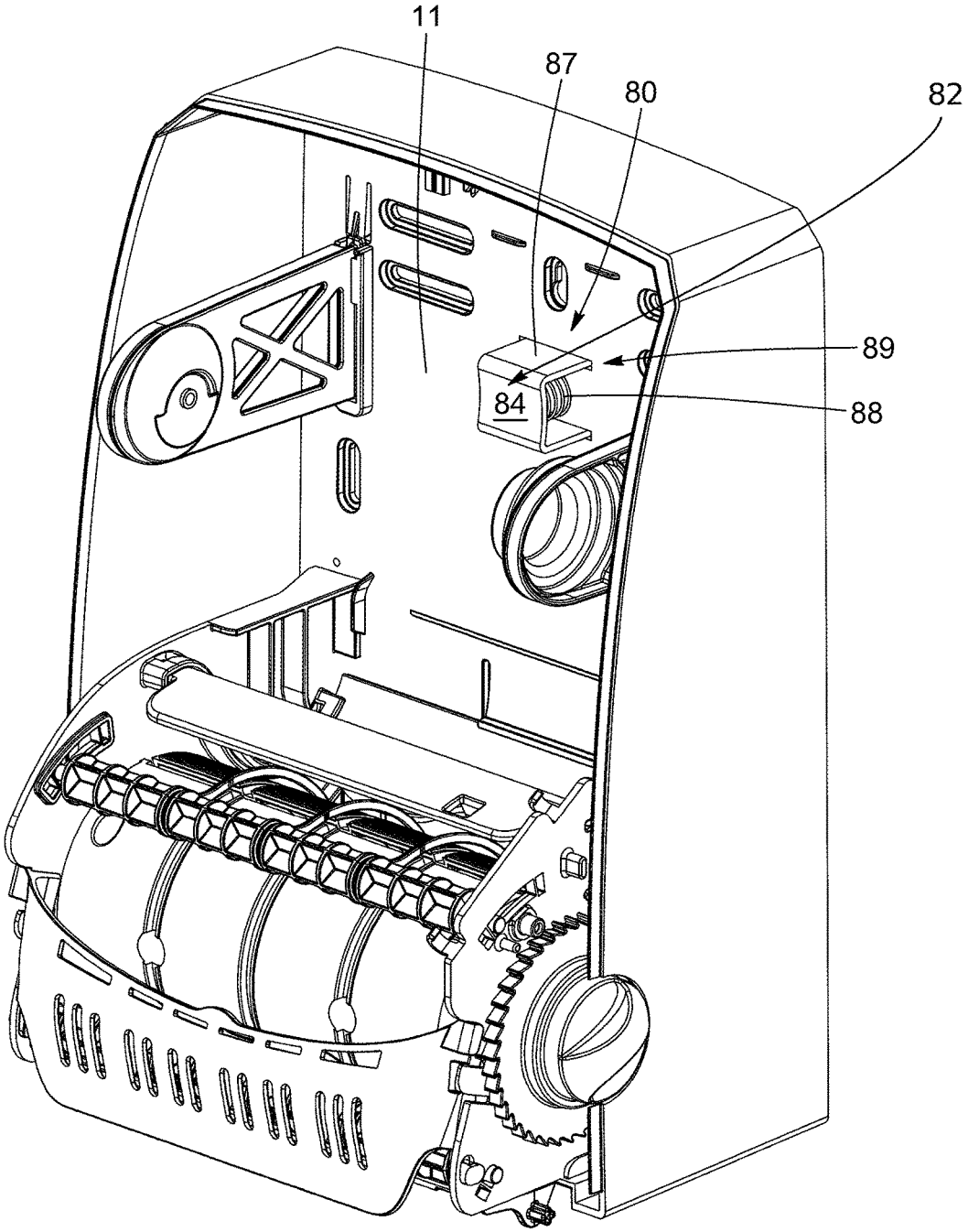
FIG. 3 is perspective view of a rolled product dispenser, according to another embodiment, with no roll of rolled product mounted thereto and including a roll braking assembly mounted to a rear section of a housing of the rolled product dispenser.

In an embodiment, the abutment surface 84 can be configured to match the contour of the outer peripheral wall 15*b*. As shown in FIG. 3, the abutment surface 84 can be provided with a profile which matches the contour of the outer peripheral wall 15*b* of the roll 15. As can be appreciated, the contour of the outer peripheral wall 15*b* will vary according to the diameter 15*c* (i.e. depletion state) of the roll 15. Therefore, in possible embodiments, the profile of the abutment surface 84 can be configured to match a contour of the outer peripheral wall 15*b* of a full roll, or a semi-depleted roll.

As can be appreciated, the roll braking assembly 80 can be mounted in other locations while still allowing the abutment surface 84 to abut against the outer peripheral wall 15*b* of the roll 15. In an embodiment, and with reference to FIG. 4, the roll braking assembly 80 can be mounted to the front section 13 of the housing 12. In the presently illustrated embodiment, the roll braking assembly 80 is mounted to the front cover 9 comprised in the front section 13. The roll abutment member 82 is biased away from the front section 13 by the biasing mechanism 88, causing the abutment surface 84 to abut against the outer peripheral wall 15*b* of the roll 15.

As can be appreciated, in alternate embodiments, the roll braking mechanism 80 can be provided in any combination of the above-described configurations. For example, roll braking mechanisms 80 can be provided in both the rear 11 and front 13 sections of the housing 12 to simultaneously abut against the roll 15 on opposite sides. Similarly, roll braking mechanisms 80 can be provided in the front 13 and rear 11 of the housing in combination with roll braking mechanisms 80 in the support arms 26, 27, to abut against the side 15*a* and peripheral 15*b* surfaces of the roll simultaneously or individually at different stages as the roll 15 is depleted.

Figure 6:
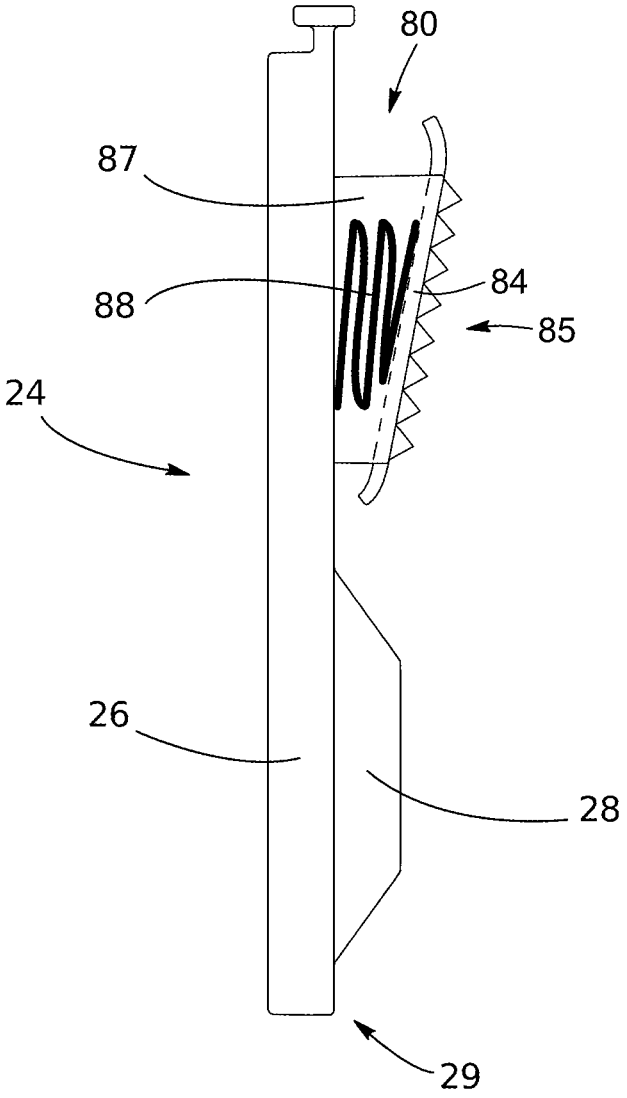
FIG. 6 is a cross-sectional plan view of a support arm of a roll support including a roll braking assembly, according to an embodiment wherein an abutment surface of a roll abutment member includes a friction-enhancing texture.

As can also be appreciated, the abutment surface 84 can be configured to increase friction with the outward-facing surfaces 15*a*, 15*b* of the roll 15. In an embodiment, and with reference to FIG. 6, the abutment surface 84 of the roll braking mechanism 80 can be provided with a texture 85. In the illustrated embodiment, the abutment member 82 is made from molded plastic and is formed such that the abutment surface 84 comprises a triangular rib texture. In alternate embodiments, the texture 85 can comprise a different material than that of the abutment member 82. For example, the texture 85 can be made of rubber molded in or apposed on the abutment surface 84.

Several alternative embodiments and examples have been described and illustrated herein. The embodiments of the invention described above are intended to be exemplary only. A person skilled in the art would appreciate the features of the individual embodiments, and the possible combinations and variations of the components. A person skilled in the art would further appreciate that any of the embodiments could be provided in any combination with the other embodiments disclosed herein. It is understood that the invention may be embodied in other specific forms without departing from the central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind without significantly departing from the scope of the invention as defined in the appended claims.

The invention claimed is:

1. A paper towel dispenser for dispensing paper towels from a paper towel roll having two outward-facing side surfaces, the paper towel dispenser comprising:

a housing;

a roll support provided in the housing and comprising at least one support arm extending along one of the outward-facing side surfaces of the paper towel roll, the at least one support arm having a roll engagement end comprising a roll engagement member for rotatably supporting the paper towel roll around an axis of rotation;

a roll braking assembly for reducing overspinning of the paper towel roll, the roll braking assembly comprising:

at least one roll abutment member mounted to the at least one support arm, the at least one roll abutment member having an abutment surface and a biasing surface, opposite to the abutment surface, and being configured to abut and bias against the one of the outward-facing side surface of the paper towel roll, and apply a friction force thereon which decreases as the roll is depleted; and a biasing member extending between the at least one support arm and the biasing surface of the at least one roll abutment member and biasing the abutment surface of the at least one roll abutment member towards the one of the outward-facing side surfaces of the paper towel roll; and a dispensing assembly provided in the housing for dispensing the paper towels from a tail portion of the paper towel roll.

2. The paper towel dispenser according to claim 1, wherein the abutment surface of the at least one roll abutment member is tapered towards an end of the abutment surface adjacent to the roll engagement member.

3. The paper towel dispenser according to claim 1, wherein the at least one support arm comprises two support arms extending along opposite sides of the roll and the at least one roll abutment member comprises two roll abutment members and each one of the two support arms comprises a respective one of the roll abutment members.

4. The paper towel dispenser according to claim 1, wherein the at least one roll abutment member further comprises guide walls extending laterally from opposite sides of the abutment surface and the at least one support arm comprises slots, the guide walls fitting within corresponding slots to allow a translation of the abutment surface toward and away from the outward-facing side surface of the roll.

5. The paper towel dispenser according to claim 1, wherein the biasing member is a compressive element which exerts an increasing force on the at least one roll abutment member as the biasing member is compressed and the at least one roll abutment member is offset from the axis of rotation of the roll.

6. The paper towel dispenser according to claim 1, wherein the at least one roll abutment member is positioned such that a surface area of the at least one roll abutment member abutting the outward-facing side surface of the roll reduces as the roll is depleted and that a biasing force biasing the abutment surface towards the outward-facing side surface of the roll reduces as the roll is depleted.

7. A rolled product dispenser for dispensing a rolled product from a roll having an outward-facing side surface, the rolled product dispenser comprising:

a frame comprising at least one support arm extending along the side surface of the roll and having a roll engagement end comprising a roll engagement member for supporting the roll and allowing the roll to rotate around an axis of rotation; and a roll braking assembly mounted to the at least one support arm for reducing over-rotation of the roll around the axis of rotation, the roll braking assembly comprising: at least one roll abutment member having an abutment surface and a biasing surface, opposite to the abutment surface; and a biasing member extending between the at least one support arm and the biasing surface of the at least one roll abutment member and biasing the abutment surface of the at least one roll abutment member towards the outward-facing side surface of the roll, the at least one roll configured to abut against and bias towards the outward-facing side surface of the roll and create friction therewith;

wherein the roll braking assembly is configured such that the friction between the abutment surface and the outward-facing side surface of the roll reduces as the rolled product is depleted from the roll.

8. The rolled product dispenser according to claim 7, wherein the roll braking assembly comprises a biasing member biasing the abutment surface of the at least one roll abutment member towards the outward-facing side surface of the roll.

9. The rolled product dispenser according to claim 7, wherein the abutment surface is tapered towards an end of the abutment surface adjacent to the roll engagement member.

10. The rolled product dispenser according to claim 8, wherein the at least one roll abutment member further comprises guide walls extending laterally from opposite sides of the abutment surface and a biasing surface opposite the abutment surface; and the at least one support arm comprises slots, the guide walls fitting within corresponding slots in the at least one support arm to allow a translation of the abutment surface toward and away from the outward-facing side surface of the roll and the biasing member extending between the frame and the biasing surface.

11. The rolled product dispenser according to claim 7, wherein the biasing member is a compressive element which exerts an increasing force on the at least one roll abutment member as the biasing member it is compressed.

12. The rolled product dispenser according to claim 7, wherein the at least one roll abutment member is offset from the axis of rotation of the roll.

13. The rolled product dispenser according to claim 7, wherein the at least one roll abutment member comprises two roll abutment members provided on opposite outward-facing side surfaces of the roll, when the roll is engaged with the roll engagement member.

14. The rolled product dispenser according to claim 7, wherein the at least one roll abutment member is positioned such that substantially an entire surface area of the abutment surface is in contact with the outward-facing side surface of the roll when the roll is substantially non-depleted.

15. The rolled product dispenser according to claim 7, wherein the at least one roll abutment member is positioned such that a surface area of the at least one roll abutment member abutting the outward-facing side surface of the roll reduces as the roll is depleted.

16. The rolled product dispenser according to claim 7, wherein the at least one roll abutment member is positioned such that a biasing force biasing the abutment surface towards the outward-facing side surface of the roll reduces as the roll is depleted and the abutment surface of the at least one roll abutment member is textured.

* * * * *